United States Patent [19]

Young

[11] 4,188,722

[45] Feb. 19, 1980

[54] CUTTING TOOL FOR REMOVING A NUT SECURELY FASTENED TO A BOLT

[76] Inventor: John O. Young, 8448 W. 83rd St., Justice, Ill. 60458

[21] Appl. No.: 932,560

[22] Filed: Aug. 10, 1978

[51] Int. Cl.[2] ..... B25D 3/00; B25D 17/02

[52] U.S. Cl. ..... 30/168; 29/275

[58] Field of Search ..... 30/168; 29/275, 277

[56] References Cited

U.S. PATENT DOCUMENTS

| | | | |
|---|---|---|---|
| 2,853,723 | 9/1958 | Winslow | 29/275 X |
| 3,000,097 | 9/1961 | Hartz | 29/275 X |
| 3,231,972 | 1/1966 | Annese | 30/168 |

*Primary Examiner*—Jimmy C. Peters

*Attorney, Agent, or Firm*—Laff, Whitesel & Rockman

[57] ABSTRACT

A cutting tool is provided to efficiently remove a nut from a bolt. An enlongated rod is bifurcated at its lower end to form a pair of arms having cutting edges. A guide collar disposed between the arms is shaped to receive the free end of the bolt and properly position the tool over the nut.

8 Claims, 3 Drawing Figures

CUTTING TOOL FOR REMOVING A NUT SECURELY FASTENED TO A BOLT

BACKGROUND OF THE INVENTION

This invention relates to a cutting tool and more particularly, to a cutting tool for removing a nut from a bolt.

Nuts and bolts on cars, trucks and the like which are exposed to the weather often become rusted making removal of a nut from a bolt by conventional means difficult and, sometimes, impossible. In addition, the nut which is desired to be removed is often located in an area where it is difficult to use conventional tools, such as wrenches. For example, a nut rusted to a bolt holding one end of a shock absorber to the frame of a car, or the bolt on an exhaust manifold can be difficult to remove because of their location and the lack of space within which to work with conventional tools. Thus, there is a need for a simple tool that can efficiently remove a nut that has become rusted to a bolt or otherwise securely fastened to a bolt and which can be used in cramped spaces.

Accordingly, a primary object of the present invention is to provide a new and improved cutting tool which can efficiently remove a nut securely fastened to a bolt.

Another object of my invention is to provide a cutting tool that can quickly remove a nut securely fastened to a bolt in an area that is dificult to reach with conventional tools.

Yet another object of my invention is to provide a cutting tool which can be pivoted slightly about the free end of a bolt when removing a nut attached to the bolt to facilitate removal in locations that are difficult to reach with commonly known tools.

A further object of my invention is to provide a cutting tool for removing a nut securely fastened to a bolt which can be used with either a pnuematic hammer or a hand-held hammer.

Still another object of my invention is to provide a cutting tool for removing a nut from a bolt by splitting the nut in half and thereby separating it from the bolt.

A further object of my invention is to provide a new and improved cutting tool which is simple in construction and easy to manufacture.

In the preferred embodiment of my invention, an elongated rod is bifurcated at its lower end to form a pair of arms having cutting edges disposed on the lower extremities of the arms. A guide collar is disposed between the pair of arms to receive the free end of a bolt. The inner diameter of the guide collar is somewhat larger than the diameter of a standard automotive bolt, allowing the cutting tool the freedom to pivot slightly whereby the tool can be used in spaces which are not easily accessible. By placing the guide collar over the free end of a bolt, the cutting edges can be directed to rest on the nut fastened to the bolt. Blows applied to the top of the rod with a hammer will cause the cutting edges to split the nut in half, thereby separating it from the bolt.

DETAILED DESCRIPTION OF THE INVENTION

Figure 1:
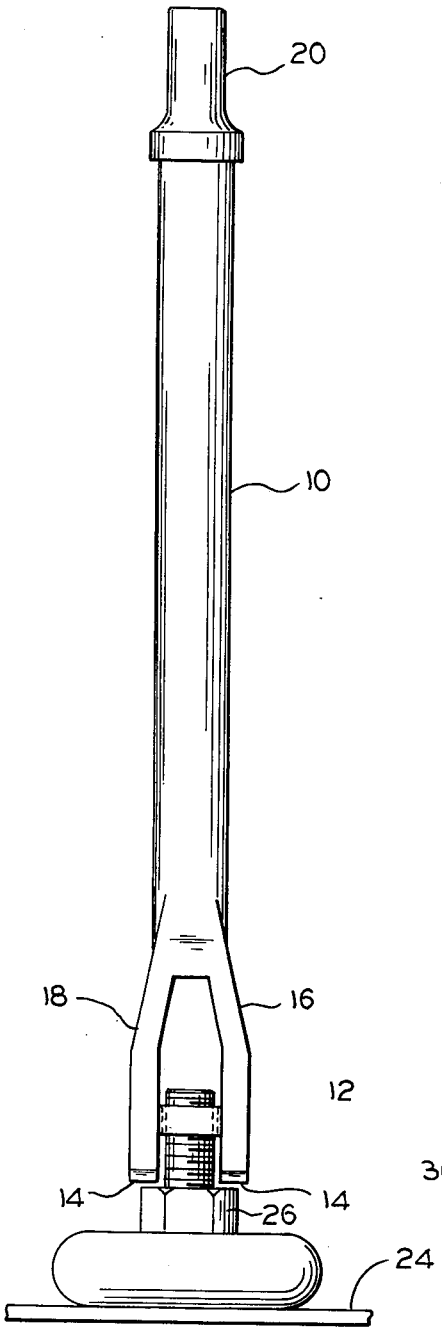
FIG. 1 is a side elevation view of the disclosed invention.

As shown in FIG. 1, a cutting tool constructed in accordance with my invention comprises elongated rod 10, guide collar 12, and chisel-shaped cutting edges 14. Rod 10 is bifurcated at its lower end and forms arms 16, 18 with cutting edges 14 disposed at the end of each arm. Cap 20 is affixed to the upper end of rod 10 to provide a surface to apply a pnuematic hammer or common hand-held hammer.

In FIG. 1, my tool cutter is shown in place over a bolt 22 which is attached to the frame 24 of an automobile. In the preferred embodiment, a nut 26 on bolt 22 secures a shock absorber linkage arm 28 to the frame 24. After long periods of use, nut 26 becomes rusted fast to bolt 22, making it impractical to remove nut 26 by simply unthreading the nut from bolt 22. Thus, my inventive tool is adapted to remove nut 26 from bolt 22 economically by cutting the nut in half when it becomes necessary or desirable to remove the existing shock absorber. Since the nut has become rusted, it should be replaced altogether. Also, my novel nut cutting tool can be used to remove nuts which have rusted fast to bolts at other locations on the automobile, such as the bolts holding parts of the exhaust system to the frame, for example.

Figure 2:
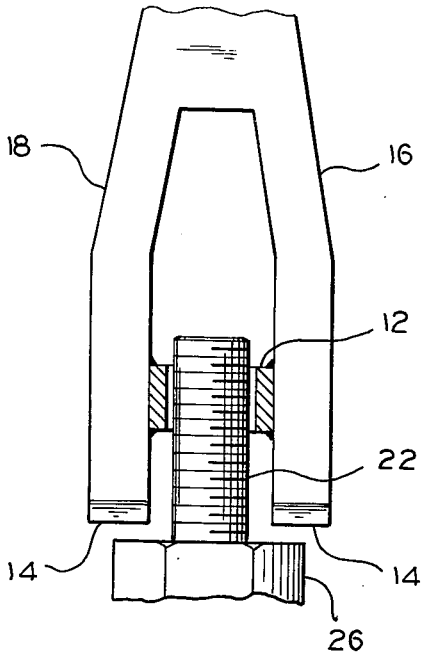
FIG. 2 is a partial cross-section view of one embodiment of the disclosed invention.

In one embodiment of my invention, as shown in FIG. 2, guide collar 12 is disposed between arms 16, 18 and rigidly affixed to each arm by welding or brazing, for example. The diameter of collar 12 is substantially larger than the diameter of bolt 22, and is designed to accommodate the free end of bolt 16 with a loose fit while guiding the tool over the bolt 22, thereby permitting the cutting tool to pivot slightly about the bolt 16.

Figure 3:
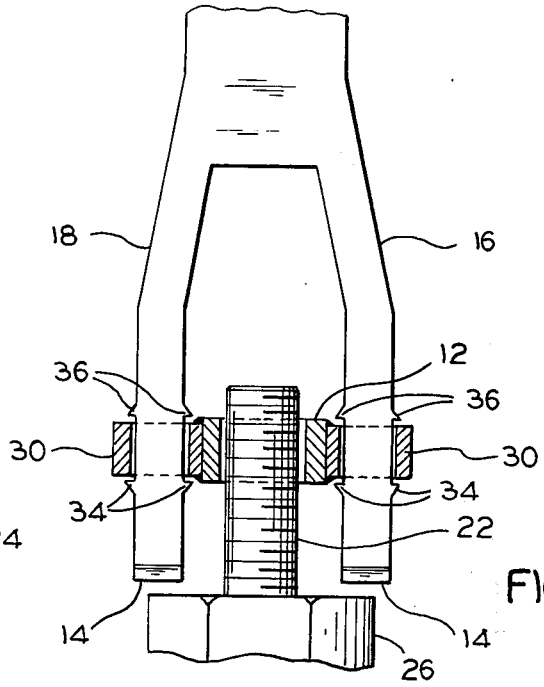
FIG. 3 is a partial cross-section view of a second embodiment of the disclosed invention.

In a second embodiment of my invention, as shown in FIG. 3, two ring members 30 are affixed to opposite sides of collar 12. The ring members 30 fit around arms 16, 18 between stops 34, 36 on each arm. The inside diameters of ring members 30 are slightly larger than the width of arms 16, 18 providing a loose fit and thereby permitting collar 12, and the cutting tool, to pivot about the free end of bolt 16.

The pivoting movement about the free end of bolt 16 provided for in both embodiments of my invention facilitates access of the cutting tool to cramped locations in an automobile chasis which are difficult to reach with cutting tools commonly known.

To use my invention, guide collar 12 is placed over the free end of bolt 22 with cutting edges 14 resting adjacent nut 26. Repeated application of an impact force such as by blows from a pnuematic hammer or common hand-held hammer are applied to cap 20, forcing the chisel edges 14 to cut nut 26 in half and thereby separating the nut 26 from bolt 16. The shock absorber linkage arm, exhaust system bracket, or other automotive accessory part can then be removed from bolt 22 and replaced. Since collar 12 is adapted to freely ride over the bolt 22, the bolt is not destroyed and can be used again.

While the principles of my invention have been described above in connection with specific embodiments and applications, it is to be understood that this description is made only by way of example and not as a limitation on the scope of the appended claims.

I claim:

1. A cutting tool for removing a nut which is securely fastened to a bolt comprising:

an elongated rod; means defining arms disposed at the lower end of said rod; cutting means disposed at the lower edges of said arms; and a collar rigidly disposed between said arms and having an inside diameter greater than the diameter of said bolt whereby said collar loosely fits over the free end of said bolt positioning said cutting means on said nut fastened to said bolt so that said nut is split in half and thereby separated from said bolt when an impact force is applied to one end of said rod while permitting said elongated rod to be pivoted about the free end of said bolt to facilitate removal of said nut in locations that are difficult to reach with commonly known tools.

2. The cutting tool of claim 1 wherein said cutting means comprise a pair of chisel edges disposed on the lower extremities of said arms.

3. The cutting tool of claim 1 including a cap disposed on the top end of said elongated rod opposite said cutting means to provide a surface to apply an impact force.

4. The cutting tool of claim 1 wherein said collar is welded to said arms.

5. A cutting tool for removing a nut which is securely fastened to a bolt comprising:

an elongated rod; means defining arms disposed at the lower end of said rod; cutting means disposed at the lower edges of said arms; and a collar shaped to receive the free end of said bolt; ring members rigidly affixed to opposite sides of said collar, said ring members engaging said arms in a loose fit whereby said elongated rod may be pivoted slightly about the free end of said bolt when said tool is placed over the free end of said bolt; and means defining a plurality of stops on said arms whereby said ring members are disposed between said stops and prevented from moving in an axial direction along said arms.

6. The cutting tool of claim 5 wherein said ring members are welded to opposite sides of said collar.

7. The cutting tool of claim 5 or 6 wherein said cutting means comprise a pair of chisel edges disposed on the lower extremities of said arms.

8. The cutting tool of claim 5 including a cap disposed on the top end of said elongated rod opposite said cutting means to provide a surface to apply an impact force.

* * * * *